US011448064B2

(12) United States Patent
Schaeffer et al.

(10) Patent No.: US 11,448,064 B2
(45) Date of Patent: Sep. 20, 2022

(54) COMPRESSIBLE LOAD SHOULDER FOR DAMPENING SHOCK IN DOWNHOLE TELEMETRY TOOL

(71) Applicant: HALLIBURTON ENERGY SERVICES, INC., Houston, TX (US)

(72) Inventors: Alexander J. Schaeffer, Houston, TX (US); Mukul M. Agnihotri, Spring, TX (US); Ravi P. Nanayakkara, Kingwood, TX (US); Matthew Hui Chong, Spring, TX (US); Carl E. Brown, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 429 days.

(21) Appl. No.: 16/743,843

(22) Filed: Jan. 15, 2020

(65) Prior Publication Data

US 2021/0215038 A1 Jul. 15, 2021

(51) Int. Cl.
*E21B 47/18* (2012.01)

(52) U.S. Cl.
CPC ..... *E21B 47/18* (2013.01)

(58) Field of Classification Search
CPC ..... E21B 47/18
USPC ..... 367/81
See application file for complete search history.

(56) References Cited

U.S. PATENT DOCUMENTS

| | | | |
|---|---|---|---|
| 9,644,434 | B2 | 5/2017 | Frith |
| 2015/0176377 | A1 | 6/2015 | Agarwal |
| 2015/0211318 | A1 | 7/2015 | Redlinger et al. |
| 2017/0328142 | A1 | 11/2017 | Pratt et al. |
| 2018/0171726 | A1 | 6/2018 | Donald et al. |

FOREIGN PATENT DOCUMENTS

| | | | |
|---|---|---|---|
| WO | WO-2005047640 A2 | 5/2005 | |
| WO | WO-2021007483 A1 * | 1/2021 | ..... E21B 21/10 |

OTHER PUBLICATIONS

Korean Intellectual Property Office, PCT/US2020/013749, International Search Report and Written Opinion, dated Sep. 29, 2020, 15 pages, Korea.

* cited by examiner

*Primary Examiner* — Ted M Wang
(74) *Attorney, Agent, or Firm* — Haynes and Boone, LLP

(57) ABSTRACT

A mud pulse telemetry tool includes a dampener for reducing shock and vibration. The mud pulse telemetry tool includes a housing having a shoulder formed along an inner surface thereof, the housing including an orifice formed therein. A piston assembly is longitudinally movable in the housing between a retracted position and an extended position. The piston assembly includes a poppet disposable in the orifice in the extended position and a piston connected to the poppet. The dampener is disposed longitudinally between the piston and the shoulder, the piston being movable in contact with the dampener when the piston assembly is in the extended position.

20 Claims, 7 Drawing Sheets

COMPRESSIBLE LOAD SHOULDER FOR DAMPENING SHOCK IN DOWNHOLE TELEMETRY TOOL

BACKGROUND

The disclosure relates generally to wellbore operations, such as drilling for hydrocarbon production. More particularly, the disclosure relates to shock absorbing structures for downhole telemetry tools such as mud-pulse tools that generate pressure pulses in a wellbore fluid for sending measurement-while-drilling (MWD) data to the surface or for other downhole communications.

Mud-pulse telemetry systems may modulate the flow of drilling fluid by varying the position of a poppet with respect to an orifice through which the drilling fluid flows, thereby encoding downhole data in pressure pulses that propagate up the drill string. The pressure pulses may then be detected by pressure transducers at the surface. In some implementations, including drilling of long lateral wells, one or more friction reduction tools may be run on the drill string, which may attenuate positive mud-pulse signals and reduce surface detectable signal levels. Such mud-pulse signal attenuation may be compensated for by generating higher amplitude pressure pulses downhole, thereby increasing surface detectable signals and providing a more reliable MWD service to operators.

To generate higher amplitude pressure pulses, mud-pulse tools may be designed having tighter poppet and orifice combinations, creating smaller flow areas through the tool. Other design changes may be implemented to cause a piston in the tool to move at a faster velocity. These changes may cause the piston to impact a metal stop with greater energy, thereby increasing an amount of impact loading on a lower end of the mud-pulse tool. In some conventional applications, attempts have been made to dampen or mitigate this increased shock with limited success. For example, a shock sonde has been positioned between the pulser tool and a sensor sonde in the drill string, Introduction of the shock sonde may have negatively affected the overall performance by increasing tool length, increasing sensor to bit distance, and increasing cost.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
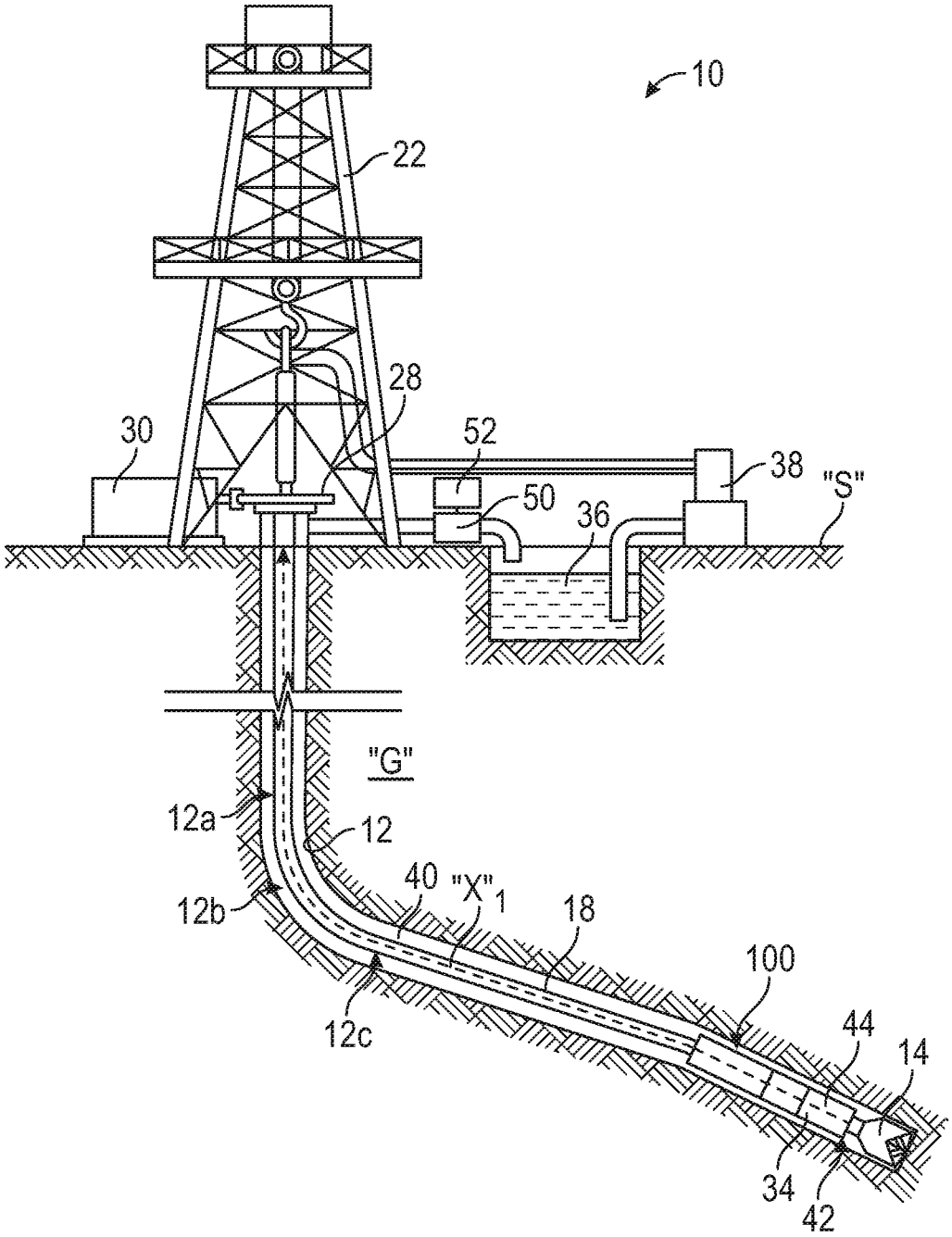
FIG. 1 is a cross-sectional schematic side-view of a drilling system including a mud pulse telemetry tool deployed on a drill string in accordance with one or more exemplary embodiments of the disclosure.

Disclosed herein are embodiments of a downhole mud pulse telemetry tool including a shock and vibration dampener positioned at the point of impact for a piston that is selectively movable to generate pressure pulses in a downhole mud flow. The dampener may be retrofit to existing mud pulse telemetry tools and may enable operating mud pulse telemetry tools to generate high amplitude pressure pulses that are reliably detectable at surface while reducing and/or preventing detrimental effects of shock and vibration on sensitive electronics in the drill string. Referring to FIG. 1, a drilling system 10 is illustrated that includes a downhole mud pulse telemetry tool 100, in accordance with one or more embodiments of the present disclosure. Although drilling system 10 is illustrated in the context of a terrestrial drilling operation, it will be appreciated by those skilled in the art that aspects of the disclosure may also be practiced in connection with offshore platforms and or other types of hydrocarbon exploration and recovery systems as well.

Drilling system 10 is partially disposed within a directional wellbore 12 traversing a geologic formation "G." The directional wellbore 12 extends from a surface location "S" along a curved longitudinal axis $X_1$. In some exemplary embodiments, the longitudinal axis $X_1$ includes a vertical section 12*a*, a build section 12*b* and a tangent section 12*c*. The tangent section 12*c* is the deepest section of the wellbore 12, and generally exhibits lower build rates (changes in the inclination of the wellbore 12) than the build section 12*b*. In some exemplary embodiments (not shown), the tangent section 12*c* is generally horizontal. Additionally, in one or more other exemplary embodiments, the wellbore 12 includes a wide variety of vertical, directional, deviated, slanted and/or horizontal portions therein, and may extend along any trajectory through the geologic formation "G."

A rotary drill bit 14 is provided at a downhole location in the wellbore 12 (illustrated in the tangent section 12*c*) for cutting into the geologic formation "G." When rotated, the drill bit 14 operates to break up and generally disintegrate the geological formation "G." At the surface location "S" a drilling rig 22 is provided to facilitate rotation of the drill bit 14 and drilling of the wellbore 12. The drilling rig 22 includes a turntable 28 that generally rotates the drill string 18 and the drill bit 14 together about the longitudinal axis $X_1$. The turntable 28 is selectively driven by an engine 30, chain drive system or other or other apparatus. Rotation of the drill string 18 and the drill bit 14 together may generally be referred to as drilling in a "rotating mode," which maintains the directional heading of the rotary drill bit 14 and serves to produce a straight section of the wellbore 12, e.g., vertical section 12*a* and tangent section 12*c*.

In contrast, a "sliding mode" may be employed to change the direction of the rotary drill bit 14 and thereby produce a curved section of the wellbore 12, e.g., build section 12*b*, To operate in sliding mode, the turn table 28 may be locked such that the drill string 18 does not rotate about the longitudinal axis $X_1$, and the rotary drill bit 14 may be rotated with respect to the drill string 18. To facilitate rotation of the rotary drill bit 14 with respect to the drill string 18, mud motor 34 is provided in the drill string 18 at a down-hole location in the wellbore 12.

The mud motor 34 generates torque in response to the circulation of a drilling fluid, such as mud 36, therethrough. The mud 36 can be pumped down-hole by mud pump 38 through an interior of the drill string 18. The mud 36 passes through the mud motor 34, which extracts energy, from the mud 36 to turn the rotary drill bit 14. As the mud 36 passes through the mud motor 34, the mud 36 may also lubricate bearings (not explicitly shown) defined therein before being expelled through nozzles (not explicitly shown) defined in the rotary drill bit 14. The mud 36 lubricates the rotary drill bit 14 and flushes geologic cuttings from the path of the rotary drill bit 14. The mud 36 is then returned through an annulus 40 defined between the drill string 18 and the geologic formation "G." The geologic cuttings and other debris are carried by the mud 36 to the surface location "S" where the cuttings and debris can be removed from the mud stream.

In accordance with some exemplary embodiments of the disclosure, the mud motor 34 or another downhole component may carry a feedback device 42 thereon for measuring a parameter of the downhole environment at a location near the rotary drill bit 14. In some exemplary embodiments, the feedback device 42 may include accelerometers, inclinometers, thermometers or other types of sensors for measuring characteristics of the wellbore 12. Also, in some exemplary embodiments, the feedback device 42 may include radiation detectors, acoustic detectors, electromagnetic detectors or other devices for measuring characteristics of the geologic formation "G" near the rotary drill bit 14. In other exemplary embodiments, the feedback device 42 may measure an operational characteristic of the drilling system 10 such as a rotational speed of the rotary drill bit 14. In still other exemplary embodiments, the particular parameter measured by the feedback device 42 may not be related to a drilling operation, and therefore, the exemplary embodiments of the feedback device 42 should not be considered limiting.

The drill string 18 may also include a data collection tool 44, such as an MWD tool or a LWD tool, disposed up-hole of the mud-motor 34. The data collection tool 44 is operable to measure, process, and/or store information therein. The data collection tool 44 may include devices (not explicitly shown) for measuring a weight on the rotary drill bit 14, for measuring a resistive torque applied to the BHA 32 by the geologic formation "G," for measuring vibrational energy and\or for measuring any other parameters associated with MWD or LWD tools as recognized by those skilled in the art.

The data collection tool 44 is operatively coupled to the mud pulse telemetry tool 100 for one or two-way communication with the surface location "S" or with other portions of the drill string 18. The mud pulse telemetry tool 100 may transmit data collected from the data collection tool 44 and/or feedback device 42 in an up-hole direction and may also receive instructions or data transmitted in a down-hole direction from the surface location "S," for example. In the exemplary embodiments illustrated FIG. 1, the mud pulse telemetry tool 100 is operable generate disturbances in a column of mud 36 in the wellbore 12 that can be detected by an up-hole receiver 50 disposed at the surface location "S." The up-hole receiver 50 is operable to detect and measure pressure changes in mud 36 and is illustrated as being in fluid communication with mud 36 in the annulus 40. However, as one skilled in the art will appreciate, the up-hole receiver 50 may additionally or alternatively be fluidly coupled to mud 36 within the drill string 18. The up-hole receiver 50 is communicatively coupled to a processing unit 52 that is operable to receive, interpret and analyze signals detected by the up-hole receiver 50.

Figure 2:
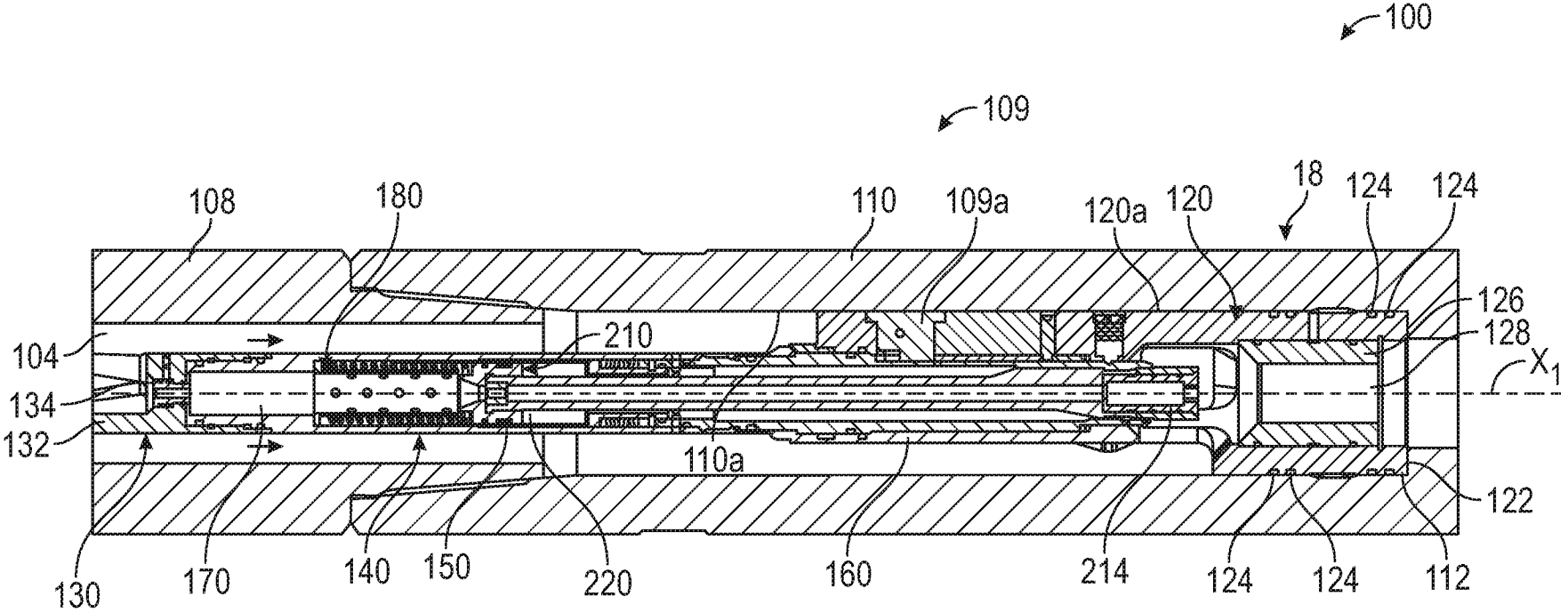
FIG. 2 is a cross-sectional side view of the downhole mud pulse telemetry tool of FIG. 1 in an initial configuration illustrating a piston assembly in a retracted position that permits mud flow through an orifice.

FIG. 2 is a section view of the downhole mud pulse telemetry tool 100 illustrating an initial configuration in which a piston assembly 210 is biased to a retracted position according to some embodiments. In general, mud pulse telemetry tool 100 is made-up to the drill string 18 or another tool string. In one or more embodiments, mud pulse telemetry tool 100 may be positioned near a lower or distal portion of drill string 18. Drill string 18 includes a bore 104 formed therethrough. Bore 104 is generally aligned along longitudinal axis $X_1$. Although not limited to such configurations, a portion of drill string 18, in this example, includes a first tubular housing or drill collar 108 and a universal bore hole orientation (LMO) sub 109. The UBHO sub 109 generally includes a second tubular housing 110 and an orientation key 109*a* appreciated by those skilled in the art. In one or more embodiments, first and second tubular housings 108, 110 may be connected end to end by a threaded connection. In one or more other embodiments, a single integral tubular housing (not shown) may be substituted for first and second tubular housings 108, 110. Second tubular housing 110 includes a cylindrical inner surface 110*a*. In one or more embodiments, second tubular housing 110 may include an upward facing annular shoulder 112 formed along cylindrical inner surface 110*a*.

A lower housing or mule shoe 120 is positioned within bore 104 of drill string 18. In one or more embodiments, lower housing 120 may be secured to second tubular housing 110 using, without limitation, fasteners or other retaining device, such as a c-shaped retaining ring, collets, or lock dogs. Lower housing 120 includes a cylindrical outer surface 120*a*. Iii one or more embodiments, cylindrical outer surface 120*a* may contact cylindrical inner surface 110*a*. In one or more embodiments, lower housing 120 may include an annular face 122 at a lower end thereof. Annular face 122 may abut annular shoulder 112 of second tubular housing 110 preventing downward movement of lower housing 120 relative to second tubular housing 110. In one or more embodiments, lower housing 120 may include one or more annular seals 124, including without limitation O-ring seals. One or more annular seals 124 may form a sealing interface between cylindrical inner surface 110*a* and cylindrical outer surface 120*a* preventing fluid leakage around lower housing 120. In one or more embodiments, lower housing 120 may include a generally cylindrical sleeve insert 126 having an orifice 128 formed therein. In one or more embodiments, a single integral housing (not shown) may be substituted for lower housing 120 and sleeve insert 126.

In one or more embodiments, mud pulse telemetry tool 100 may include a first or upper section 130 and a second or lower section 140. In one or more embodiments, first and second sections 130, 140 may be connected end to end by a threaded connection. In one or more embodiments, first section 130 may include a generally tubular first housing 132. In one or more embodiments, a pilot valve 134 may be disposed within first section 130 for regulating fluid flow and pressure in second section 140. In one or more embodiments, first section 130 may include electronics (not shown) for controlling a motor (not shown), such as a DC motor, for actuating pilot valve 134.

In some embodiments, second section 140 may include two or more releasable housing components to facilitate assembly and service of second section 140. In one or more embodiments, releasable housing components making up second section 140 may include a generally tubular plenum housing 150 and a generally tubular helix housing 160. In one or more embodiments, plenum housing 150 and helix housing 160 may be connected end to end by a torqued connection, including without limitation thread, bayonet, or breech-lock type connectors. In one or more other embodiments, a single integral housing (not shown) may be substituted for plenum housing 150 and helix housing 160. In one or more other embodiments, a single integral housing (not shown) may be substituted for first housing 132, plenum housing 150, and helix housing 160 so that first and second sections 130, 140 are constructed integrally. In one or more embodiments, second section 140 may be secured to lower housing 120 using, without limitation, fasteners, other retaining device, and/or anti-rotation lock.

In one or more embodiments, a first or upper piston chamber 170 may be formed in second section 140 within a portion of plenum housing 150. In one or more embodiments, a generally tubular perforated sleeve 180 may be disposed within first piston chamber 170. Perforated sleeve 180 may include one or more ports 180*p* (see FIG. 4) for permitting fluid flow from inside to outside of perforated sleeve 180 through one or more ports 180*p*. A second or lower piston chamber 220 may be formed in the second section 140 such that a piston assembly 210 is longitudinally movable in response to pressure differentials defined between the first piston chamber 170 and second piston chamber 220. As illustrated in FIG. 2, the piston assembly 210 is disposed in a retracted position wherein a poppet 214 is spaced from orifice 128. In the retracted position, mud may flow relatively freely through the bore 104 of the drill string 18.

Figure 3:
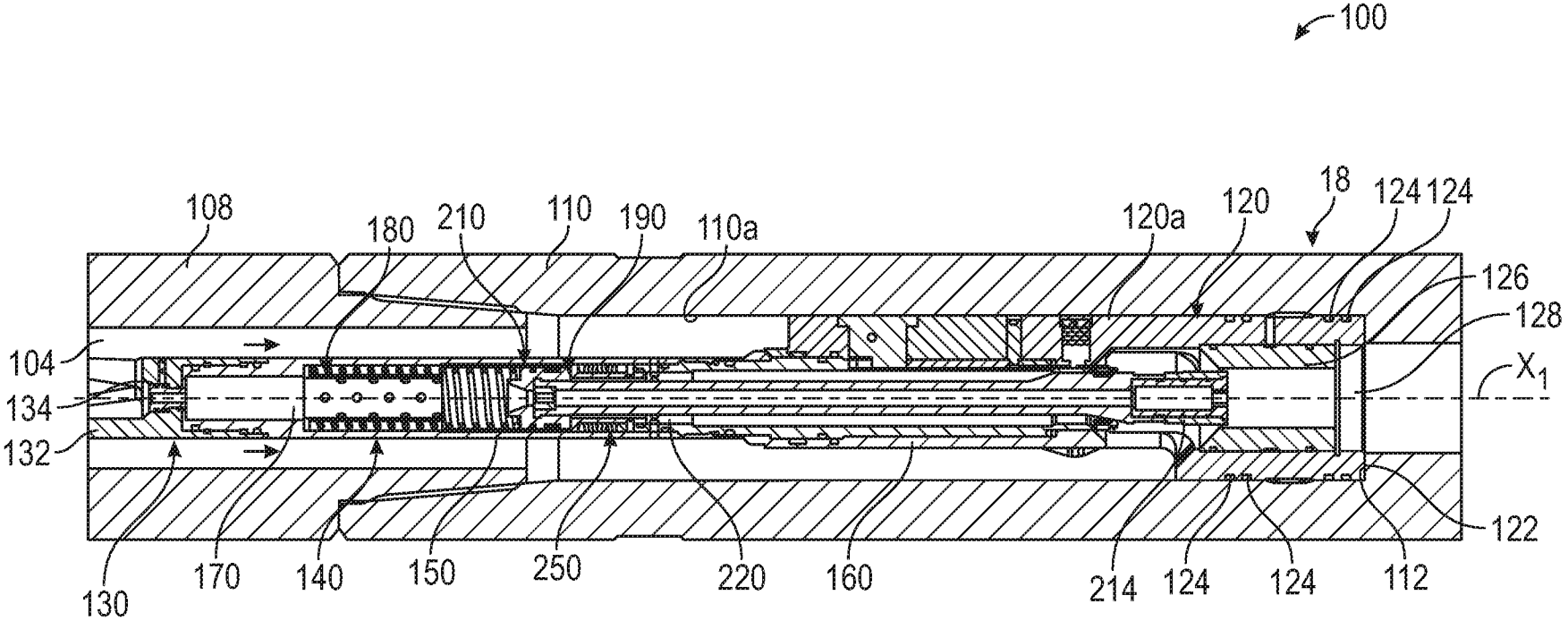
FIG. 3 is a cross-sectional side view of the downhole mud pulse telemetry tool of FIG. 1 in an actuated configuration illustrating the piston assembly in an extended position that restricts flow through the orifice.

Referring to FIG. 3, the mud pulse telemetry 100 is illustrated in an actuated configuration wherein the piston assembly 210 is moved to an extended position. In the extended position, the poppet 214 is moved into the orifice 128 such that mud flow through the orifice 128 is at least partially restricted. Restricting mud flow through the orifice 128 generates pressure disruptions in mudflow through the drill string 18 that may be detected and decoded at the up-hole receiver 50 (FIG. 1) at the surface location "S". As described in greater detail below, a shock and vibration dampener 250 is in the plenum housing 150 to absorb impact and dissipate kinetic energy of piston assembly 210 moving to the extended position.

Figure 4:
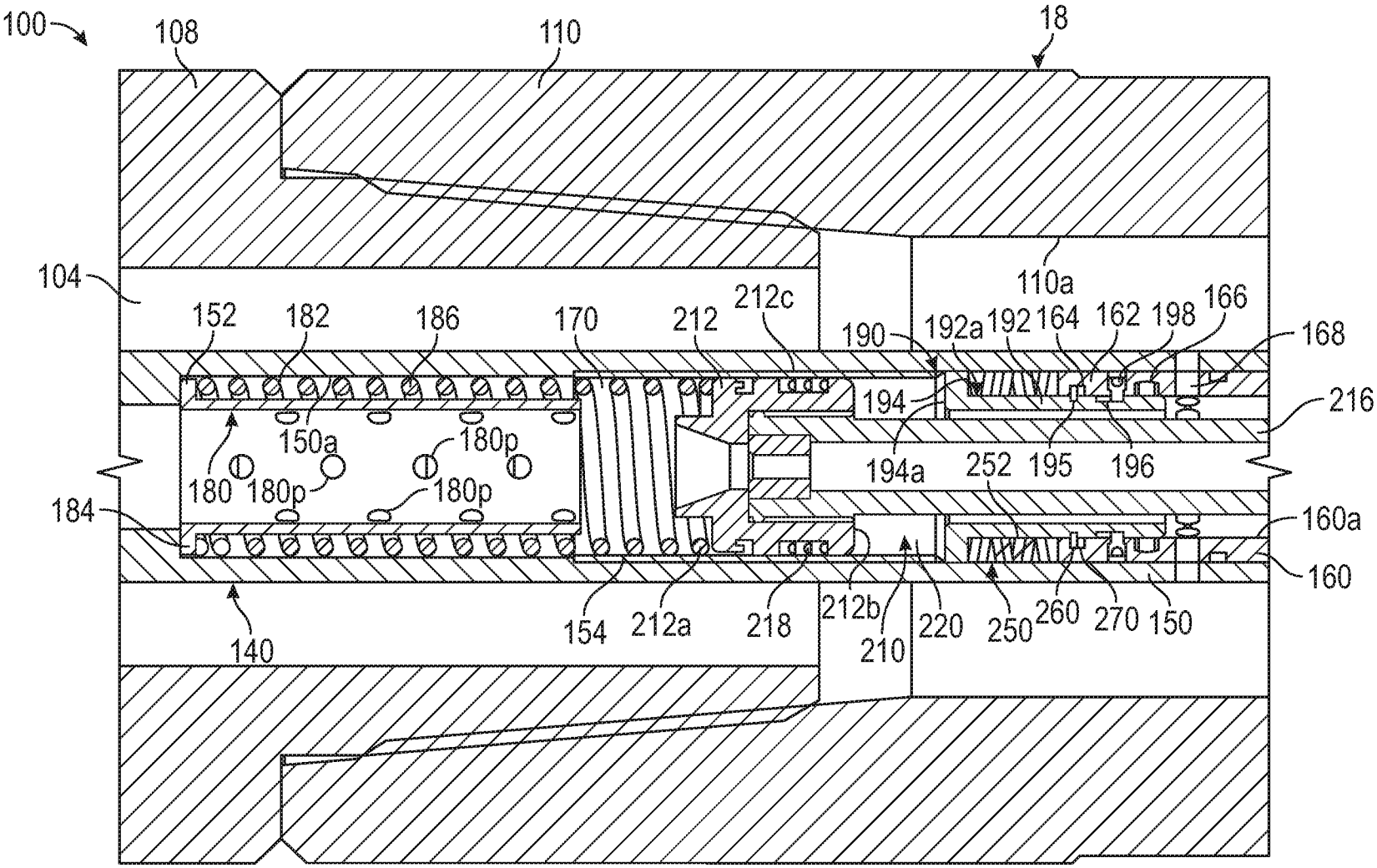
FIG. 4 is a close-up section view of the downhole mud pulse telemetry tool of FIG. 1 in an intermediate configuration wherein the piston assembly is between the extended and retracted positions, illustrating a shock and vibration dampener including according to some embodiments.

Referring to FIG. 4, the operation of the mud pulse telemetry tool 100 and the shock and vibration dampener 250 is described in greater detail. In one or more embodiments, plenum housing 150 may include a cylindrical inner surface 150 and a downward facing annular shoulder 152 formed along cylindrical inner surface 150*a*. In one or more embodiments, plenum housing 150 may include a wear sleeve 154 disposed along at least a portion of cylindrical inner surface 150*a* for improving a wear resistance of plenum housing 150.

In one or more embodiments, helix housing 160 may include a cylindrical inner surface 160*a*. A first or upper end 162 of helix housing 160 may be disposed inside plenum housing 150. First end 162 may include an upward facing annular shoulder 164, and in one or more embodiments, annular shoulders 152, 164 may oppose each other. In one or more embodiments, helix housing 160 may include one or more annular seals 166 disposed on cylindrical inner surface 160*a*. One or more annular seals 166 may include, without limitation, O-ring seals. Helix housing 160 may include one or more radial ports 168 formed therethrough. In one or more embodiments where a single integral housing (not shown) is substituted for plenum housing 150 and helix housing 160, foregoing structures described with reference to one of plenum housing 150 or helix housing 160 may be applied to such integral housing, without limitation.

Perforated sleeve 180 may include one or more ports 180*p* for permitting fluid flow from inside to outside of perforated sleeve 180 through one or more ports 180*p*. In one or more embodiments, perforated sleeve 180 may include a cylindrical sleeve portion 182 having a flange 184 at an upper end thereof. Flange 184 may contact annular shoulder 152 of plenum housing 150 while an opposite end of perforated sleeve 180 may be in contact with a piston assembly 210 (described below), at least when piston assembly 210 is in a retracted position (see FIG. 1). In one or more embodiments, a resilient member such as piston spring 186 may be disposed within first piston chamber 170 and outwardly surrounding perforated sleeve 180. More particularly, opposite ends of piston spring 186 may contact flange 184 and piston assembly 210. Thus, piston spring 186, may apply a downward force on piston assembly 210. As used herein, piston spring 186 may include any type of compression spring, including without limitation a helical or coil compression spring, as illustrated.

In one or more embodiments, second section 140 may include a spring mandrel 190 disposed within and connected to helix housing 160. In one or more embodiments, spring mandrel 190 may include a cylindrical sleeve portion 192 having a flange 194 formed at one end thereof. Sleeve portion 192 includes a cylindrical outer surface 192*a*. In one or more embodiments, an annular groove 195 may be formed in cylindrical outer surface 192*a*. Flange 194 may include a stop surface 194*a* for contacting piston assembly 210. In one or more embodiments, stop 194*a* may be an upward facing annular face of flange 194. In one or more embodiments, one or more generally longitudinal slots 196 may be formed in cylindrical outer surface 192*a* by milling or other suitable methods. In one or more embodiments, cylindrical outer surface 192*a* may be in sealing contact with one or more annular seals 166 of helix housing 160 forming a sealing interface between spring mandrel 190 and cylindrical inner surface 160*a* and preventing fluid leakage and erosion around spring mandrel 190. Spring mandrel 190 may be secured to helix housing 160 using one or more fasteners 198, including without limitation set screws. In one or more embodiments, fasteners 198 may engage slots 196 to define a longitudinal position of the spring mandrel 190 within the helix housing 160. In one or more embodiments, engagement between fasteners 198 and slots 196 may allow spring mandrel 190 to be moved downward while preventing or limiting upward movement of spring mandrel 190. In one or more embodiments, spring mandrel 190 may be replaceable in the field.

Piston assembly 210 may be disposed within second section 140. In operation, piston assembly 210 may be axially movable through second section 140 from the first or retracted position (see FIG. 1) to a second or extended position (see FIG. 3). In one or more embodiments, piston assembly 210 may include a piston 212 and a poppet 214 (see FIG. 1) connected at opposite ends of piston assembly 210. generally tubular poppet shaft 216 may extend longitudinally between piston 212 and poppet 214. In this example, piston assembly 210 is assembled using threaded connections, although other types of connections may be used, if desired. In one or more embodiments, spring mandrel 190 may slide over poppet shaft 216 during assembly. In one or more embodiments, a second or lower piston chamber 220 may be formed between poppet shaft 216 and cylindrical inner surfaces 150*a*, 160*a*. One or more radial ports 168 of helix housing 160 may permit fluid communication between bore 104 of drill string 18 and second piston chamber 220.

Now turning to piston assembly 210 more particularly, piston 212 may include a first or upper end 212*a* and a second or lower end 212*b* facing away from first end 212*a*. In one or more embodiments, first end 212*a* may be exposed to first piston chamber 170 and may be in contact with piston spring 186. Second end 212*b* may be exposed to second piston chamber 220 and may be longitudinally separated from the stop 194*a*, at least when the piston assembly 210 is in the retracted position. The second end 212*b* may be in contact with stop 194*a*, at least when piston assembly 210 is in the extended position (see FIG. 3), Piston 212 includes a generally cylindrical outer surface 212*c* extending longitudinally between first and second ends 212*a*, 212*b*. In one or more embodiments, piston 212 may include one or more dynamic seals 218, including without limitation polypak seals, u-cup seals, or chevron seals disposed along outer surface 212*c*. One or more dynamic seals 218 may form a sealing interface between piston 212 and cylindrical inner surface 150*a* or wear sleeve 154 preventing fluid communication between first and second piston chambers 170, 220. In one or more embodiments, spring mandrel 190 and piston assembly 210 may be integrally formed. In one or more embodiments, poppet 214 may extend into orifice 128, at least when piston assembly 210 is in the extended position (see FIG. 3).

In one or more embodiments, shock and vibration dampener 250 may be radially positioned between spring mandrel 190 and cylindrical inner surface 150*a* of plenum housing 150. In one or more embodiments, an inner diameter of cylindrical inner surface 150*a* may be approximately 1.5 inches or less. In a longitudinal direction, dampener 250 may be positioned between flange 194 of spring mandrel 190 and annular shoulder 164 of helix housing 160. In one or more embodiments, piston 212 and dampener 250 may be in indirect contact with each other through spring mandrel 190 when piston assembly 210 is in the extended position (see FIG. 3). In one or more embodiments, dampener 250 may be constructed to withstand high impact loading, such as forces greater than 1,000 lbf. In one or more embodiments, an outer diameter of dampener 250 may be approximately 1.5 inches or less. In one or more embodiments, dampener 250 may enable a drop-in installation, wherein dampener 250 can be retrofit to existing pulser tools. Using dampener 250 in off-the-shelf pulser tools may lower costs and improve ease of implementation. In some examples, dampener 250 can be installed in second section 140 before second section 140 is assembled. More particularly, dampener 250 can be installed in helix housing 160 before plenum housing 150 is attached thereto.

In one or more embodiments, dampener 250 may include one or more resilient members such as springs 252. Although not limited to such configurations, dampener 250 as illustrated in FIG. 2 includes a stack of Belleville springs. In some other embodiments, one or more springs 252 may include, without limitation, disc springs, wave springs, or coil springs. In one or more embodiments, one or more springs 252 may be pre-assembled on spring mandrel 190. In one or more embodiments, one or more springs 252 may compress to absorb impact of piston assembly 210 and convert kinetic energy of piston assembly 210 to strain energy within one or more springs 252.

In one or more embodiments, a thrust washer 260 may be positioned between dampener 250 and annular shoulder 164. In one or more embodiments, thrust washer 260 may engage a fixture for compressing one or more springs 252 during a pre-loading procedure. In one or more embodiments, thrust washer 260 may prevent rotational movement of dampener 250.

In one or more embodiments, a retaining ring 270 may be at least partially disposed about spring mandrel 190. In one or more embodiments, retaining ring 270 may be disposed in annular groove 195 formed in cylindrical outer surface 192*a*. Retaining ring 270 may pre-load dampener 250 to improve a fatigue resistance thereof. In one or more embodiments, pre-loading may compress one or more springs 252 to approximately 0-15% of a working height thereof. Preload may improve fatigue resistance by preventing stress reversals in one or more springs 252.

In one or more other embodiments, dampener 250 may be mounted directly on poppet shaft 216. In such embodiments, spring mandrel 190 can be eliminated, and fasteners 198, thrust washer 260, and retaining ring 270 may be disposed directly on poppet shaft 216.

Figure 5:
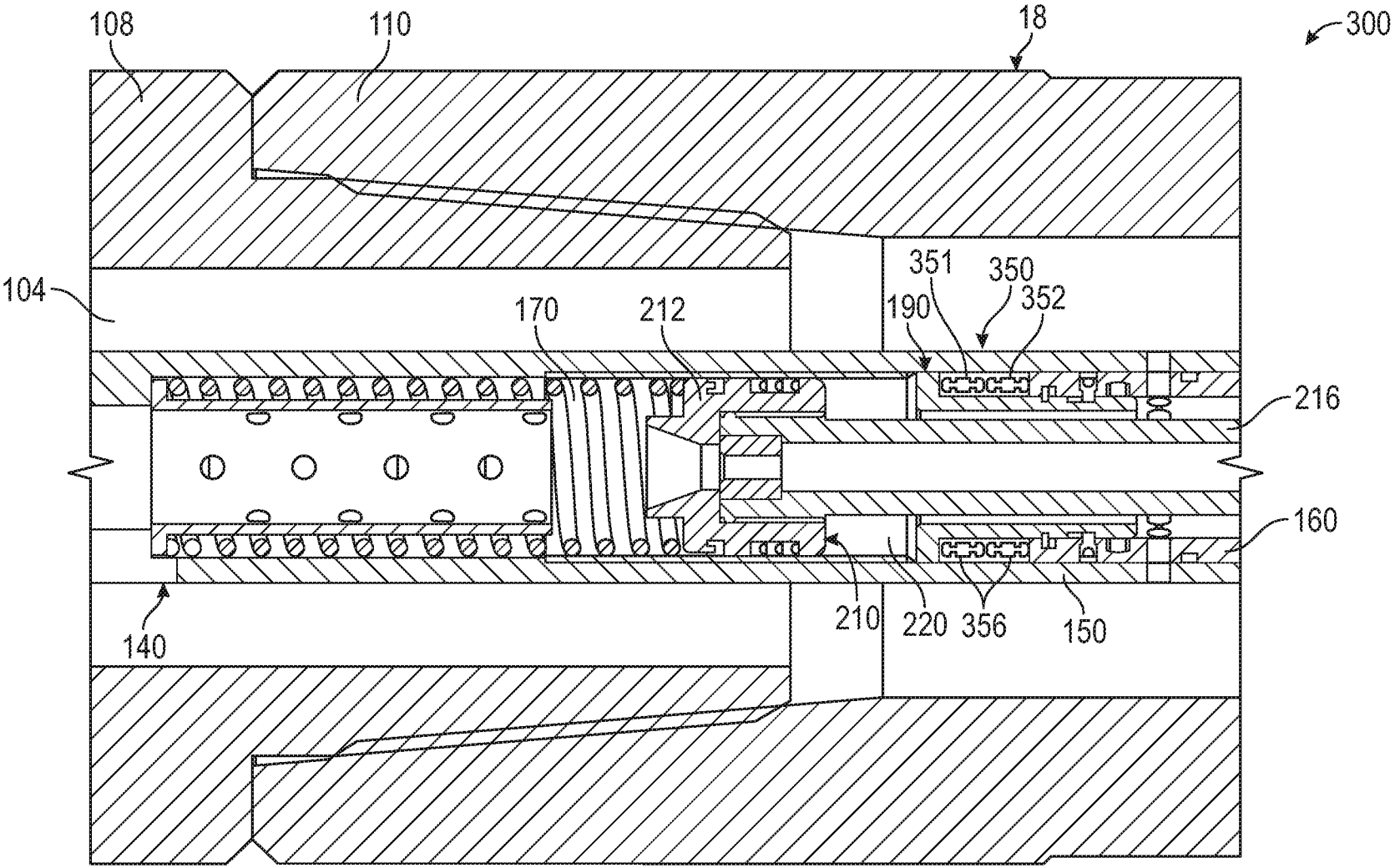
FIG. 5 is a close-up section view of an alternate embodiment of a mud pulse telemetry tool including a shock and vibration dampener including a stack of elastic spacers.

Referring to FIG. 5, in one or more other embodiments, a mud pulse telemetry tool 300 may include a dampener 350 constructed of one or more resilient members such as elastic spacers 351, 352. In one or more embodiments, the spacers 351, 352 may be a solid sleeve having a generally cylindrical or annular profile. In one or more embodiments, the spacer 351, 352 may include machined features, including without limitation grooves 356, slots, or corrugations, to reduce a stiffness thereof. In one or more embodiments, the spacers 351, 352 may be formed of brass, beryllium copper, aramid fibers or other synthetic fibers, high-strength rubber or polymer-based materials, reinforced composites, or a combination thereof. In one or more embodiments, the spacers 351, 352 may be composed of different of distinct materials from one another. In any case, the dampener 350 can elastically deform to absorb impact of piston assembly 210 with the spring mandrel 190 and convert kinetic energy of piston assembly 210 to strain energy within the dampener 350. After impact, the spring mandrel 190 moves longitudinally downward with the piston assembly 210 with respect to the plenum housing 150, and the spacers 351, 352 are compressed, thereby absorbing the impact.

Figure 6:
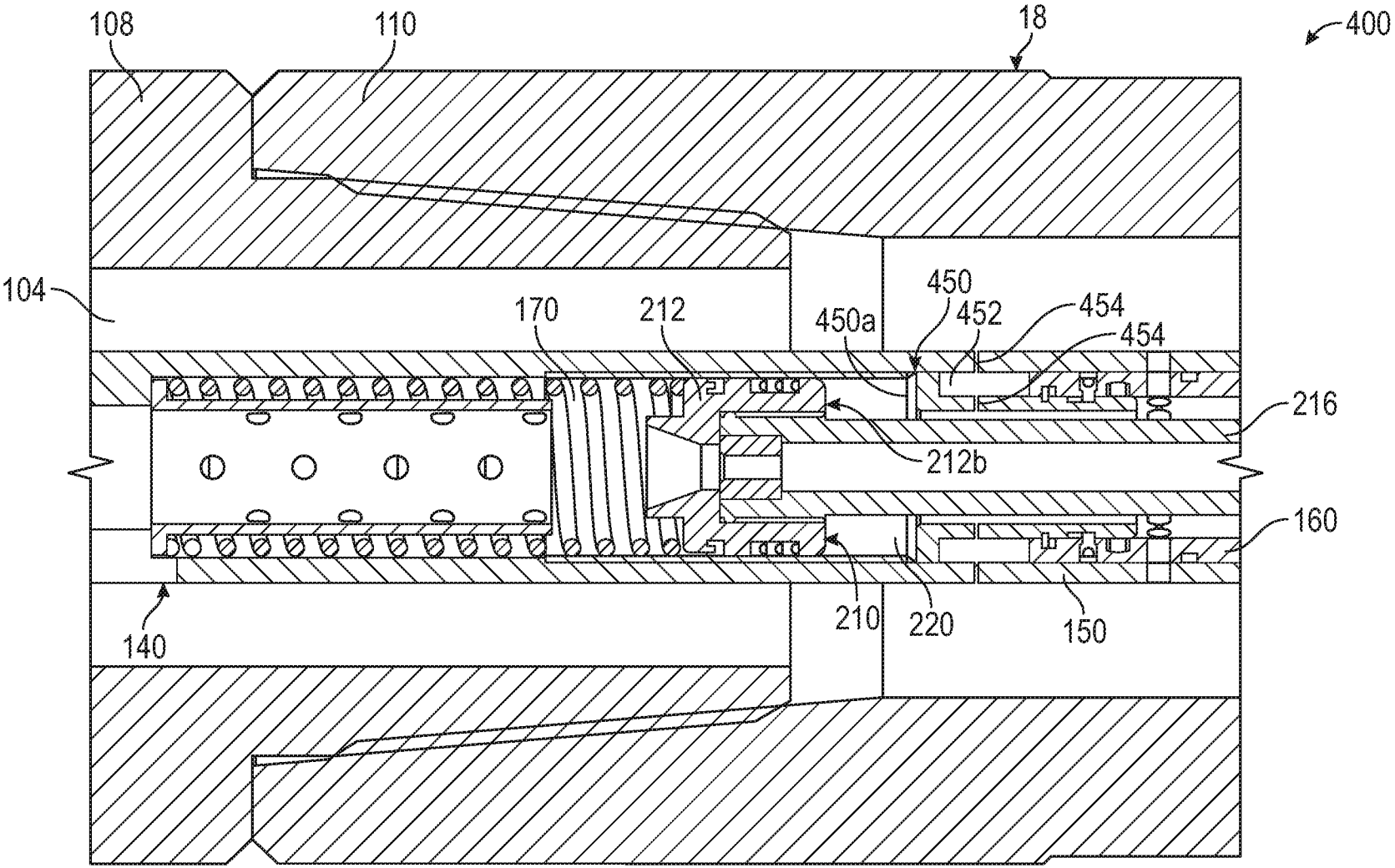
FIG. 6 is a close-up section view of an alternative embodiment of a mud pulse telemetry tool including a shock and vibration dampening structure including a flow mandrel employing fluid compression in place of mechanical springs or spacers, which may be subject to fatigue or failure in operation.

Referring to FIG. 6, in one or more other embodiments, a mud pulse telemetry tool 400 may include a longitudinally movable flow mandrel 450. The flow mandrel 450 generally permits a fluid to dampen the shock of a pulser actuating without the need for mechanical springs or spacers, which may be susceptible to failure or fatigue in operation. In one or more embodiments, the flow mandrel 450 may be constructed in a generally similar manner as spring mandrel 190 (FIG. 4). In one or more embodiments, the flow mandrel 450 and adjoining structures plenum housing 150 and helix housing 160 may form a variable-volume fluid chamber 452. In one or more embodiments, the flow mandrel 450 and the variable volume fluid chamber 452 may be in fluid communication with each other. In one or more embodiments, the flow mandrel 450 may be prevented from rotating by splines, keys or other mechanisms (not shown) defined between the flow mandrel 450 and the helix housing 160, for example. In one or more embodiments, a fluid in the chamber 452 may include drilling fluid, other downhole fluids or a fluid specifically selected for to provide a predetermined bulk modulus or other characteristics. In one or more embodiments, the flow mandrel 450 and adjoining structures 150, 160 may be formed of hardened materials and/or have a hardened coating applied thereon to improve erosion resistance, if desired.

In one or more embodiments, second end 212*b* of piston 212 may engage an end 450*a* of the flow mandrel 450 and move the flow mandrel 450 longitudinally. In one or more embodiments, a fluid volume in second piston chamber 220 may be forced through and/or around the flow mandrel 450 as the piston assembly 210 moves downward. The fluid may flow through ports 454, which may have a predetermined size and represent a predetermined flow restriction into or out of the chamber 452. In one or more embodiments, a volume of the chamber 452 may be reduced as the flow mandrel 450 moves downward toward the helix housing. In other words, the flow mandrel 450 may be longitudinally movable between a first position where the fluid chamber 452 has a first volume and a second position where the fluid chamber 452 has a second volume less than the first volume. Thus, when a volume of the chamber 452 decreases at a faster rate than fluid can exit the chamber 452 through ports 454, a volume of trapped fluid may inhibit further movement of the flow mandrel 450. The trapped fluid may be incompressible, such as for example, drilling fluid, and may absorb impact of piston assembly 210 and dissipate kinetic energy of piston assembly 210 through the trapped fluid in the fluid chamber 452.

In one or more embodiments, any combination of springs 252 (FIG. 4), spacers 351, 352 (FIG. 5), and mandrel 450 (FIG. 6) may be used to specifically tailor stiffness and deflection characteristics of a dampener depending on various parameters, including without limitation, pulser design, flow rate, mud weight, or a combination thereof. In one or more embodiments, dampener 250 may include both one or more springs 252 and the movable flow mandrel 450.

Figure 7:
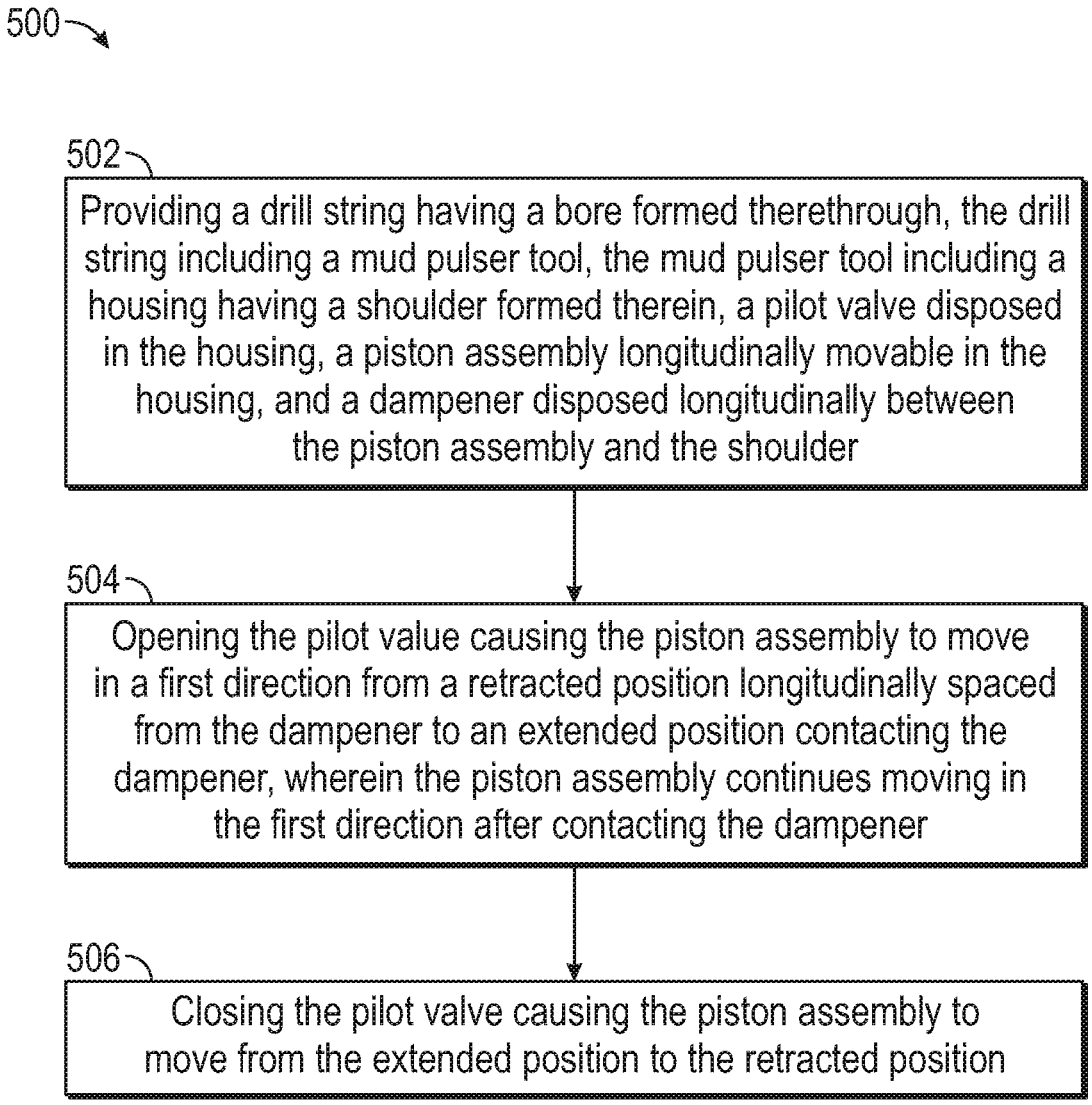
FIG. 7 is a flow chart illustrating a method for operating a downhole mud pulse telemetry tool according to some embodiments of the disclosure.

Referring to FIG. 7 a method 500 for operating the downhole mud pulse telemetry tool of FIGS. 1-4 will be now be described in detail.

At block 502, method 500 proceeds by providing drill string 18 including mud pulse telemetry tool 100. Operation of mud pulse telemetry tool 100 may begin from an initial or retracted position as illustrated in FIG. 2. In the retracted position, pilot valve 134 is closed blocking fluid communication between bore 104 and first piston chamber 170. On the other hand, bore 104 may be continuously in fluid communication with second piston chamber 220 through one or more radial ports 168 of helix housing 160. Therefore, a pressure drop is created across piston 212 where a pressure in second piston chamber 220 acting on second end 212*b* is greater than a pressure in first piston chamber 170 acting on first end 212*a*. In one or more embodiments, this pressure drop may overcome a downward force of piston spring 186 against piston assembly 210 causing piston assembly 210 to move toward and/or remain in the retracted position. In one or more embodiments, first end 212*a* may be in contact with perforated sleeve 180 when piston assembly 210 is in the retracted position. In one or more other embodiments, first end 212*a* may be spaced from perforated sleeve 180 in the retracted position as there is no functional requirement that piston 212 and perforated sleeve 180 be in contact with each other. In one or more embodiments, poppet 214 may be longitudinally spaced from orifice 128 when piston assembly 210 is in the retracted position. In one or more embodiments, mud pulse telemetry tool 100 may remain in the retracted position as long as fluid pressure in bore 104 is maintained at a level capable of overcoming spring force of piston spring 186 when said pressure is applied at second end 212*b*.

At block 504, method 500 proceeds by opening pilot valve 134 causing piston assembly 210 to move in a first direction from a retracted position longitudinally spaced from dampener 250 to an extended position contacting dampener 250, wherein piston assembly 210 continues moving in the first direction after contacting dampener 250. In one or more embodiments, opening pilot valve 134 initiates a mud pulse using mud pulse telemetry tool 100. More particularly, opening pilot valve 134 restores fluid communication between bore 104 and first piston chamber 170. In one or more embodiments, fluid may flow through one or more ports 180*p* of perforated sleeve 180 to enable fluid pressure to act on first end 212*a*, at least when perforated sleeve 180 is in contact with piston 212. In any case, pressure is substantially equalized across piston 212 when pilot valve 134 is open. In one or more embodiments, first and second ends 212*a*, 212*b* of piston 212 have approximately equal effective piston area. Therefore, when pressure is equalized, piston 212 may be substantially pressure balanced. In one or more embodiments, this pressure balance causes the downward force of piston spring 186 against piston assembly 210 to become controlling, causing piston assembly 210 to move toward the extended position. In one or more embodiments, piston assembly 210 may move at a linear velocity of approximately 40 inches per second. In one or more embodiments, piston assembly 210 continues moving downward, eventually causing second end 212*b* of piston 212 to contact stop 194*a* of spring mandrel 190. In one or more embodiments, poppet 214 may extend into orifice 128 before piston 212 contacts stop 194*a*. Extending poppet 214 into orifice 128 creates a pressure pulse in the fluid that can be detected at surface.

In some implementations, where second section 140 does not include spring mandrel 190, piston 212 may contact annular shoulder 164 of helix housing 160. In such cases, piston 212 may impact annular shoulder 164 at high velocity causing kinetic energy of piston assembly 210 to induce shock and vibration within helix housing 160. Resulting shock and vibration may be transferred to other components of mud pulse telemetry tool 100 and eventually to first section 130, which may have undesirable effects on sensitive electronics inside first section 130. In one or more embodiments, electronic components may experience damage and/or failure due to said shock and vibration effects.

In one or more embodiments, using dampener 250 in conjunction with spring mandrel 190 may help dissipate kinetic energy of piston assembly 210 before annular shoulder 164 receives the high velocity impact from piston 212 as described in the foregoing. In such embodiments, after piston 212 contacts stop 194*a*, operation of mud pulse telemetry tool 100 transitions to a dampening phase for reducing and/or preventing an amplitude of shock and vibration effects within mud pulse telemetry tool 100, More particularly, the dampening phase may absorb energy from impact loading of piston assembly 210 on helix housing 160 using dampener 250 in conjunction with spring mandrel 190.

In one or more embodiments, after piston 212 contacts stop 194*a*, spring mandrel 190 begins to move downward against dampener 250 as piston assembly 210 continues toward the extended position. More particularly, dampener 250 may be compressed between flange 194 and annular shoulder 164. In one or more embodiments where dampener 250 includes one or more springs 252, downward or impact force of piston assembly 210 may compress one or more springs 252. Compression of one or more springs 252 may convert kinetic energy of piston assembly 210 to strain energy within one or more springs 252. In one or more other embodiments where a dampener includes an elastic spacer (see, e.g., FIG. 5), impact force of piston assembly 210 may compress and elastically deform the elastic spacer and convert kinetic energy of piston assembly 210 to strain energy within the elastic spacer.

In one or more other embodiments where a dampener includes a flow mandrel (see, e.g., FIG. 6), impact force of piston assembly 210 may move the flow mandrel longitudinally downward. As the flow mandrel moves downward, a fluid volume in second piston chamber 220 may be forced through and/or around the flow mandrel and a flow area through and/or around the mandrel may be reduced. During continued movement of the flow mandrel, when a volume of the chamber decreases at a faster rate than fluid can exit the chamber, a volume of trapped fluid may be inhibited or prevented from passing through and/or around the flow mandrel. Thus, in this case, dampener 250 may dissipate kinetic energy of piston assembly 210 through the trapped fluid.

At block 506, method 500 proceeds by closing pilot valve 134 causing piston assembly 210 to move from the extended position to the retracted position. More particularly, closing pilot valve 134 blocks fluid communication between bore 104 and first piston chamber 170. However, bore 104 remains in fluid communication with second piston chamber 220 through one or more radial ports 168. Therefore, a pressure drop is re-established across piston 212 where a pressure in second piston chamber 220 acting on second end 212*b* is greater than a pressure in first piston chamber 170 acting on first end 212*a*. This pressure drop may overcome a downward force of piston spring 186 against piston assembly 210 causing piston assembly 210 to move toward the retracted position. In one or more embodiments, poppet 214 may retract from orifice 128 as piston assembly 210 moves toward the retracted position so that poppet 214 is longitudinally spaced from orifice 128 when piston assembly 210 is in the retracted position. In one or more embodiments, mud pulse telemetry tool 100 may remain in the retracted position as long as pilot valve 134 remains closed and fluid pressure in bore 104 is maintained at a level capable of overcoming spring force of piston spring 186 when said pressure is applied at second end 212*b*.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect of the disclosure, a mud pulse telemetry tool system includes a housing having a shoulder formed along an inner surface thereof. The housing includes an orifice formed therein. A piston assembly is longitudinally movable in the housing between a retracted position and an extended position. The piston assembly includes a poppet disposable in the orifice in the extended position, and a piston connected to the poppet. The tool system also includes a dampener disposed longitudinally between the piston and the shoulder. The piston and the dampener being engaged and movable with each other when the piston assembly is in the extended position.

In one or more embodiments, the dampener includes one or more springs. The one or more springs may include at least one of disc springs, wave springs, or coil springs. In some embodiments the dampener includes at least one elastic spacer, the at least one elastic spacer including a cylindrical sleeve. The at least one elastic spacer may include a plurality of stacked sleeves having different material compositions.

In some embodiments, the dampener further includes a spring mandrel disposed longitudinally between the piston and the one or more resilient members, and the piston and the spring mandrel are in direct contact with each other and movable against a bias of the one or more resilient members one when the piston assembly is in the extended position. The tool one or more resilient members may be coupled longitudinally between the spring mandrel and the shoulder of the housing, and the one or more resilient members include at least one of the group consisting of disc springs, wave springs, coil springs and a cylindrical sleeve. In some embodiments, the tool system further includes a retainer coupled between the spring mandrel and the housing to maintain the one or more resilient member in a pre-loaded state.

In some embodiments, the dampener includes a flow mandrel in fluid communication with a variable volume fluid chamber formed in the housing, the flow mandrel being longitudinally movable between a first position where the fluid chamber has a first volume and a second position where the fluid chamber has a second volume less than the first volume. In some embodiments, the dampener further includes a spring mandrel disposed longitudinally between the piston and at least one compressible member of the dampener, the piston and the spring mandrel in direct contact with each other when the piston assembly is in the extended position.

In some embodiments, the variable volume fluid chamber contains an incompressible fluid therein, and a port extends to the to the variable volume fluid chamber to provide a predetermined flow restriction into or out of the variable volume fluid chamber.

In one or more embodiments, the piston includes a first end in fluid communication with a first piston chamber formed in the housing, a second end facing away from the first end, the second end being in fluid communication with a second piston chamber formed in the housing, and an outer surface extending longitudinally between the first and second ends, the outer surface being in sealing contact with the inner surface of the housing, the sealing contact preventing fluid communication between the first and second piston chambers. The housing may be connected in a drill string, the drill string having a bore formed therethrough. In some embodiments, the housing includes one or more radial ports, the bore of the drill string being in fluid communication with the second piston chamber through the one or more radial ports. The tool system in some embodiments may further include a pilot valve disposed in the housing, the pilot valve being in a closed position and blocking fluid communication between the bore of the drill string and the first piston chamber when the piston assembly is in the retracted position. The dampener may be deformable by the piston. In some embodiments, the system further includes a piston spring coupled between the housing and the piston to bias the piston to the retracted position.

In another aspect, a method of operating a mud pulse telemetry tool includes (a) providing a drill string having a bore formed therethrough, the drill string including the mud pulse telemetry tool, the mud pulse telemetry tool including a housing having a shoulder formed therein, a pilot valve disposed in the housing, a piston assembly longitudinally movable in the housing, and a dampener disposed longitudinally between the piston assembly and the shoulder, (b) opening the pilot valve causing a piston of the piston assembly to move in a first direction from a retracted position longitudinally spaced from the dampener to an extended position contacting the dampener, and (c) continuing to move the piston assembly in the first direction after contacting the dampener.

In some embodiments, the method further includes closing the pilot valve causing the piston assembly to move from the extended position to the retracted position. Opening the pilot valve may establish fluid communication between the bore and a first piston chamber formed in the housing so that the piston assembly is pressure balanced.

In one or more embodiments, continuing to move the piston assembly in the first direction includes deforming at least one resilient member. The method may further include impacting a spring mandrel of the dampener with the piston, and wherein continuing to move the piston assembly in the first direction may include moving the spring mandrel with the piston. The dampener may further include a flow mandrel in fluid communication with a variable volume fluid chamber formed in the housing, and wherein continuing to move the piston assembly in the first direction may include moving the flow mandrel from a first position where the fluid chamber has a first volume to a second position where the fluid chamber has a second volume less than the first volume.

According to another aspect, the disclosure is directed to a mud pulse telemetry tool including a housing having a shoulder formed along an inner surface thereof, a piston longitudinally movable in the housing between a retracted position and an extended position, the piston including a first end in fluid communication with a first piston chamber formed in the housing and a second end facing away from the first end, the second end being in fluid communication with a second piston chamber formed in the housing, a spring mandrel disposed longitudinally between the piston and the shoulder, the spring mandrel having a cylindrical sleeve portion and a flange and a dampener disposed about the cylindrical sleeve portion and being in contact with the flange and the shoulder.

In one or more embodiments, the mud pulse telemetry tool further includes a piston spring disposed longitudinally between an upper shoulder formed in the housing and the first end of the piston.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A mud pulse telemetry tool system comprising:

a housing having a shoulder formed along an inner surface thereof, the housing including an orifice formed therein;

a piston assembly longitudinally movable in the housing between a retracted position and an extended position, the piston assembly including a poppet disposable in the orifice in the extended position and a piston connected to the poppet; and a dampener disposed longitudinally between the piston and the shoulder, the piston and the dampener being engaged and movable with each other when the piston assembly is in the extended position.

2. The tool system of claim 1, wherein the dampener comprises one or more resilient members deformable in response to the dampener being engaged by the piston.

3. The tool system of claim 2, wherein the dampener further comprises a spring mandrel disposed longitudinally between the piston and the one or more resilient members, the piston and the spring mandrel in direct contact with each other and movable against a bias of the one or more resilient members one when the piston assembly is in the extended position.

4. The tool system of claim 3, wherein the one or more resilient members is coupled longitudinally between the spring mandrel and the shoulder of the housing, and wherein the one or more resilient members include at least one of the group consisting of disc springs, wave springs, coil springs and a cylindrical sleeve.

5. The tool system of claim 4, further comprising a retainer coupled between the spring mandrel and the housing to maintain the one or more resilient member in a pre-loaded state.

6. The tool system of claim 1, wherein the dampener comprises a flow mandrel in fluid communication with a variable volume fluid chamber formed in the housing, the flow mandrel being longitudinally movable between a first position where the fluid chamber has a first volume and a second position where the fluid chamber has a second volume less than the first volume in response to the dampener being engaged by the piston.

7. The tool system according to claim 6, wherein the variable volume fluid chamber contains an incompressible fluid therein, and wherein a port extends to the to the variable volume fluid chamber to provide a predetermined flow restriction into or out of the variable volume fluid chamber.

8. The tool system of claim 1, wherein the piston comprises:

a first end of the piston in fluid communication with a first piston chamber formed in the housing;

a second end of the piston facing away from the first end, the second end being in fluid communication with a second piston chamber formed in the housing; and an outer surface extending longitudinally between the first and second ends, the outer surface being in sealing contact with the inner surface of the housing, the sealing contact preventing fluid communication between the first and second piston chambers.

9. The tool system of claim 8, wherein the housing is connected in a drill string, the drill string having a bore formed therethrough.

10. The tool system of claim 9, wherein the housing comprises one or more radial ports, the bore of the drill string being in fluid communication with the second piston chamber through the one or more radial ports.

11. The tool system of claim 9, further comprising a pilot valve disposed in the housing, the pilot valve being in a closed position and blocking fluid communication between the bore of the drill string and the first piston chamber when the piston assembly is in the retracted position.

12. The tool system of claim 1, further comprising a piston spring coupled between the housing and the piston to bias the piston to the retracted position.

13. A method of operating a mud pulse telemetry tool comprising:

providing a drill string having a bore formed therethrough, the drill string including the mud pulse telemetry tool, the mud pulse telemetry tool including a housing having a shoulder formed therein, a pilot valve disposed in the housing, a piston assembly longitudinally movable in the housing, and a dampener disposed longitudinally between the piston assembly and the shoulder;

opening the pilot valve causing a piston of the piston assembly to move in a first direction from a retracted position longitudinally spaced from the dampener to an extended position contacting the dampener; and continuing to move the piston assembly in the first direction after contacting the dampener.

14. The method of claim 13; further comprising closing the pilot valve causing the piston assembly to move from the extended position to the retracted position.

15. The method of claim 13, wherein opening the pilot valve establishes fluid communication between the bore and a first piston chamber formed in the housing so that the piston assembly is pressure balanced.

16. The method of claim 13, wherein continuing to move the piston assembly in the first direction comprises deforming at least one resilient member.

17. The method of claim 13, further comprising impacting a spring mandrel of the dampener with the piston, and wherein continuing to move the piston assembly in the first direction comprises moving the spring mandrel with the piston.

18. The method of claim 13, wherein the dampener includes a flow mandrel in fluid communication with a variable volume fluid chamber formed in the housing, and wherein continuing to move the piston assembly in the first direction comprises moving the flow mandrel from a first position where the fluid chamber has a first volume to a second position where the fluid chamber has a second volume less than the first volume.

19. A mud pulse telemetry tool comprising:

a housing having a shoulder formed along an inner surface thereof;

a piston longitudinally movable in the housing between a retracted position and an extended position, the piston including a first end in fluid communication with a first piston chamber formed in the housing and a second end facing away from the first end, the second end being in fluid communication with a second piston chamber formed in the housing;

a spring mandrel disposed longitudinally between the piston and the shoulder, the spring mandrel having a cylindrical sleeve portion and a flange; and a dampener disposed about the cylindrical sleeve portion and being in contact with the flange and the shoulder.

20. The mud pulse telemetry tool of claim 19, further comprising a piston spring disposed longitudinally between an upper shoulder formed in the housing and the first end of the piston.

* * * * *